US009003736B2

(12) United States Patent
Schoneveld et al.

(10) Patent No.: US 9,003,736 B2
(45) Date of Patent: Apr. 14, 2015

(54) SYSTEM FOR A FLOOR COVERING

(71) Applicant: Silicalia, SL, Valencia (ES)

(72) Inventors: Erik Schoneveld, Marxuquera (ES); Francisco Sanchis Brines, Tavernes de la Valldigna (ES); Lorente Aroca, Gandia (ES); Teresa Estruch Millet, Ador (ES); Serafin garcia Navarro, Paterna (ES)

(73) Assignee: Silicalia, SL (ES)

( * ) Notice: Subject to any disclaimer, the term of this patent is extended or adjusted under 35 U.S.C. 154(b) by 0 days.

(21) Appl. No.: 13/970,511

(22) Filed: Aug. 19, 2013

(65) Prior Publication Data

US 2014/0013698 A1 Jan. 16, 2014

Related U.S. Application Data

(63) Continuation-in-part of application No. PCT/IB2012/000370, filed on Feb. 28, 2012.

(30) Foreign Application Priority Data

Feb. 28, 2011 (EP) ..... 11380013

(51) Int. Cl.
*E04B 2/00* (2006.01)
*E04F 15/02* (2006.01)
*E04F 15/08* (2006.01)

(52) U.S. Cl.
CPC ..... *E04F 15/02038* (2013.01); *E04F 15/02005* (2013.01); *E04F 15/08* (2013.01); *E04F 2201/0517* (2013.01)

(58) Field of Classification Search
CPC ..... E04F 15/02005; E04F 15/02038; E04F 2201/05; E04F 2201/0115; E04F 2201/023; E04F 2201/0517; E04F 2201/026; E04F 13/083; E04F 13/0837; E04C 2/30
USPC ..... 52/582.1, 509, 506.05, 461, 468, 470, 52/471, 403.1, 586.1, 586.2
See application file for complete search history.

(56) References Cited

U.S. PATENT DOCUMENTS 3,363,383 A * 1/1968 La Barge ..... 52/471
3,583,120 A * 6/1971 Wangerow ..... 52/396.03

(Continued)

FOREIGN PATENT DOCUMENTS

DE 10355370 6/2005
EP A-1146182 10/2001

(Continued)

*Primary Examiner* — Brian Glessner
*Assistant Examiner* — Adam Barlow
(74) *Attorney, Agent, or Firm* — Hess Patent Law Firm LLC; Robert J. Hess

(57) ABSTRACT

A system for a floor covering that includes covering panels (10A, 10B) made of a hard material, having relatively little thickness (e), with upper and lower surfaces (1*a*, 2*a*; 1*b*, 2*b*), perimetral edges (3*a*, 3*b*) and recesses (4*a*, 4*b*), and attachment parts (20) made of a relatively flexible material and having projecting members (21*a*, 21*b*) and spacing members (22*a*, 22*b*). In practice, the projecting members (21*a*, 21*b*) of the attachment parts are introduced in the recesses (4*a*, 4*b*) of the covering panels (10A, 10B) assuring the link between covering panels (10A, 10B), and the spacing members (22*a*, 22*b*) of the attachment parts (20) remain between the facing edges (3*a*, 3*b*) of the covering panels (10A, 10B) filling a gap (G) between them in the form of a joint.

12 Claims, 3 Drawing Sheets

(56) References Cited

U.S. PATENT DOCUMENTS

| | | | | |
|---|---|---|---|---|
| 3,891,732 | A * | 6/1975 | Hurst | 264/34 |
| 4,599,841 | A * | 7/1986 | Haid | 52/396.04 |
| 4,840,825 | A | 6/1989 | Aristodimou | |
| 4,979,846 | A * | 12/1990 | Hill et al. | 404/65 |
| 6,453,632 | B1 * | 9/2002 | Huang | 52/403.1 |
| 6,763,643 | B1 * | 7/2004 | Mårtensson | 52/586.1 |
| 7,171,790 | B2 * | 2/2007 | Mei | 52/584.1 |
| 7,805,903 | B2 * | 10/2010 | Liu | 52/489.1 |
| 8,006,458 | B1 * | 8/2011 | Olofsson et al. | 52/582.1 |
| 8,276,343 | B2 * | 10/2012 | Yang | 52/584.1 |
| 2001/0010139 | A1 * | 8/2001 | De Kerpel et al. | 52/479 |
| 2002/0046527 | A1 * | 4/2002 | Nelson | 52/582.1 |
| 2002/0095894 | A1 * | 7/2002 | Pervan | 52/391 |
| 2004/0139676 | A1 * | 7/2004 | Knauseder | 52/578 |
| 2007/0107359 | A1 * | 5/2007 | Zhang | 52/582.1 |
| 2009/0107076 | A1 * | 4/2009 | Kim | 52/582.1 |

FOREIGN PATENT DOCUMENTS

| | | | |
|---|---|---|---|
| EP | 1788166 | A2 | 5/2007 |
| ES | 2265796 | A1 | 2/2007 |
| FR | 2906285 | A1 | 3/2008 |
| WO | WO 01/38668 | | 5/2001 |
| WO | WO 2012/117288 | A1 | 9/2012 |

* cited by examiner

SYSTEM FOR A FLOOR COVERING

CROSS-REFERENCE TO COPENDING PATENT APPLICATIONS

This is a continuation-in-part of international patent application serial no. PCT/IB2012/000370 filed Feb. 28, 2012.

BACKGROUND OF THE INVENTION

1. Technical Field

The present invention relates to a system for a floor covering comprising planar covering panels, such as slabs, tiles, or the like, made of marble or marble aggregate and attachment parts for connecting said covering panels to one another.

2. State of the Prior Art

In the case of covering panels such as tiles, small slabs, mosaic tiles and glazed tiles, according to a classic system, the covering panels are first applied on a bed previously prepared in a floor arranging the edges of one covering panel facing the edges of the adjacent covering panels, leaving a narrow gap between them, and then the facing edges of adjacent covering panels are grouted by filling the aforementioned gaps comprised between the edges with a grout based on lime, plaster and/or cement or the like. A drawback of this system is that the covering panels are not linked to one another, such that they can separate, the gap between them becoming wider.

Other systems for attachment contiguous covering panels to one another that are made of a hard material such as marble or a marble aggregate for floor covering are also known. Such systems have in common the fact that the edges of the covering panels are attached by means of the mutual fitting of respective recesses and projections. Nevertheless, due to the maneuver for carrying out said fitting or coupling, the recesses and projections on the edges of covering panels of a single part have the drawback of being very prone to sustaining breaks or spalling. Relatively sinuous or complicated auxiliary fixing elements are sometimes used to prevent this.

Document U.S. Pat. No. 4,840,825, for instance, relates to a tile for covering floors having a stone layer attached to a substrate made up of three sub-layers, each of them having substantially the same shape as the stone layer. A first sub-layer adjacent to the stone layer is aligned with the latter, a second intermediate sub-layer is displaced in two directions to define two projecting tongues from two edges and two grooves on the opposite edges. The third or outer sub-layer is displaced in one direction to define a projecting tab provided with two fixing holes. Therefore the tiles allow a fixing with the projecting tongues interlocking in the grooves of the adjacent tiles. The stone layer itself does not have any recess or projection for coupling it with another adjacent stone layer, but it has the drawback of needing said additional sub-layers which define the projections and grooves in order to perform the tongue and groove coupling with tiles adjacent.

On the other hand, document WO 01/38668 relates to a covering, particularly for a floor, ceiling or wall, which is characterized in that it comprises a number of successive solid covering panels of a single layer, and fixing elements. The fixing elements consist of supports which, by means of fixing portions, retain the panels in a disconnectable manner by coupling with connection elements formed through a portion of the thickness of the panels. The same document describes that the supports are fixed to a base surface and have end portions in the form of hooks which engage and hold a respective panel by opposite ends, and that each panel has profiled tongued and grooved opposite edges, which are susceptible to being coupled with another adjacent panel held in a similar manner. Nevertheless, this tongue and groove coupling of recesses and projections formed in the edges of covering panels of a single solid part has the drawback of being prone to breaking or spalling of the edges of the covering panels.

On the other hand, document DE-A-10355370 relates to a system for covering a floor comprising covering panels and attachment elements. The covering panels have an upper stone or ceramic layer, and a lower layer defining recesses in its edges. The attachment elements have holes for fixing them to a base surface and projections which are coupled to the recesses of the lower layers of two adjacent covering panels. In a coupled condition, the coupling elements are covered by the upper layers of the covering panels. This system has the drawback of needing a lower layer placed against the upper stone or ceramic layer.

Document EP 1146182 A2 discloses a floor covering system comprising adjacent flooring tiles made of a laminate material or a polymeric material such as a thermoplastic material having horizontal grooves in respective adjacent side edges and locking elements having projections inserted in said grooves lo lock the tiles to one another.

Document EP 0121915 A2 discloses a floor covering system comprising adjacent flooring boards made of wood, plastics or moisture-resistant fiber-material having horizontal grooves in respective adjacent side edges, and locking elements having projections inserted in said grooves lo lock the tiles to one another.

Document FR 1524707 A discloses a floor covering system comprising adjacent flooring boards made of solid wood or composite materials having horizontal grooves in respective adjacent side edges and locking elements having projections inserted in said grooves lo lock the tiles to one another.

However, such deep horizontal grooves of any of cited documents EP 1146182 A2, EP 0121915 A2 and FR 1524707 A, when mechanized in side edges of relatively thin solid marble or marble aggregate panels, renders the edge regions of the panels fragile under foot stepping or the like.

Document US 2007/107359 A1 teaches a floor covering system comprising a plurality of mutually adjacent flooring strip boards made of a HDF (High Density Fiberboard) or MDF (Medium Density Fiberboard) laminate material and locking elements engaging the boards to each other. A groove is formed in the vertical direction at a lower surface of each of the strip boards near side edges thereof, and said locking element comprises two projections extending from a bottom plate of the locking element which when assembling the system are inserted in respective of said grooves of adjacent strip boards. The grooves have an inner region wider than an open channel communicating therewith so that an inner wall of the grooves defines a hook portion, and the two projections of the locking element have a hook shape configured to lock in said hook portion of the grooves. A drawback with this floor covering system is that it cannot be applied to covering panels made of marble or marble aggregate because grooves having a hook portion in an inner wall thereof are very difficult, or almost impossible, to be mechanized in floor covering panels made of marble or marble aggregate.

DISCLOSURE OF THE INVENTION

The present invention provides a system for a floor covering, comprising as is conventional covering panels, such as tiles or the like, having opposite upper and lower surfaces and several perimetral edges, and attachment parts having connection elements which interact with corresponding connection elements formed in said covering panels. The covering panels are solid planar panels made of a hard material, such as marble or a marble aggregate, having little thickness, and they have recesses formed in the lower surface thereof close to said edges, and said attachment parts are made of a relatively flexible material and comprise two projecting members which are introduced in said recesses of two adjacent covering panels assuring the link of one covering panel with another covering panel. The projecting members of the attachment parts are configured to interact with said channels.

Advantageously, each of the attachment parts further comprises a spacing member extending parallel to the edges of the covering panels and arranged in the form of a joint filling a gap between the opposite edges of two adjacent covering panels when they are both coupled to one another.

The system of the present invention has the advantage of providing a technically reliable and aesthetically suitable attachment between covering panels made of a single solid piece of marble or marble aggregate without the need for one or more additionally lower layers attached to the solid layer, as occurs with some of the systems of the state of the art, and without the risk of breaks or spalling on the edges of the covering panels, as occurs with other systems of the state of the art.

The system for a floor covering of the present invention further simplifies the composition of the covering and the assembly thereof, assuring correct coplanar leveling of the upper surfaces of all the covering panels and a uniform width of the joints between them.

It is to be emphasized the simplicity of the system of the present invention since it only comprises two different elements, namely, the covering panels in the form of tiles, panels or the like, and the attachment parts. In relation to conventional covering panels, the covering panels of the present invention have only added the recesses, preferably in the form of a channel, which can be formed with relative ease using techniques that are well-known in the field of the manufacturing pieces of marble or marble aggregate, and the attachment parts can be industrially manufactured at a relatively low cost using techniques for extruding or molding plastic material.

In some applications it is common to include a flexible material layer between the lower surface of the covering panel and the floors on which the covering is applied. In such case, the flexible material layer can be adhered to the lower surface of each covering panel or it can be extended on the floor in the form of a mat for placing the attachment parts and covering panels thereon. The flexible material layer can alternatively be in the form of separate flexible layer elements and the attachment parts can be attached to the flexible layer elements.

BRIEF DESCRIPTION OF THE DRAWINGS

The foregoing and other features and advantages will be better understood from the following detailed description of several embodiments with reference to the attached drawings, in which.

DETAILED DESCRIPTION OF PREFERRED EMBODIMENTS OF THE INVENTION

Figure 1:
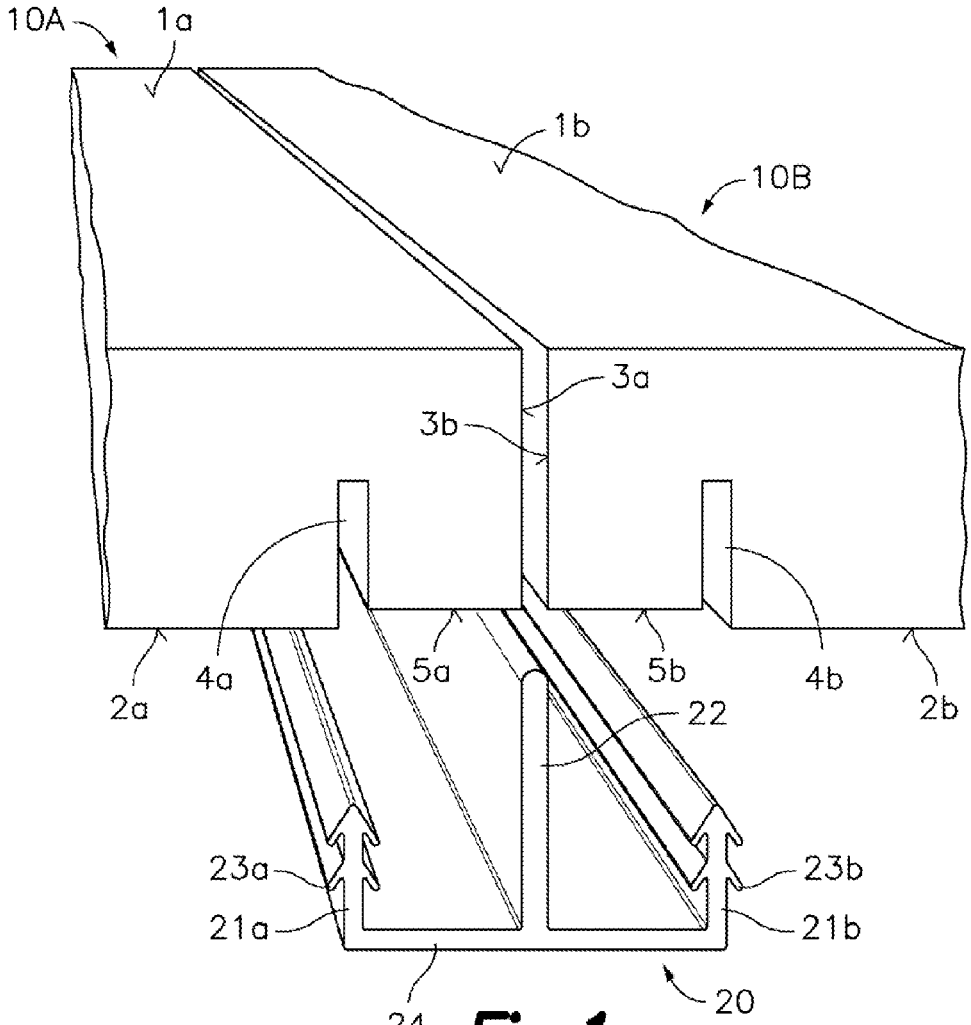
FIG. 1 is a perspective view of two covering panels and an attachment part before being attached, which form part of a system for a floor covering according to a first embodiment of the present invention.
Figure 2:
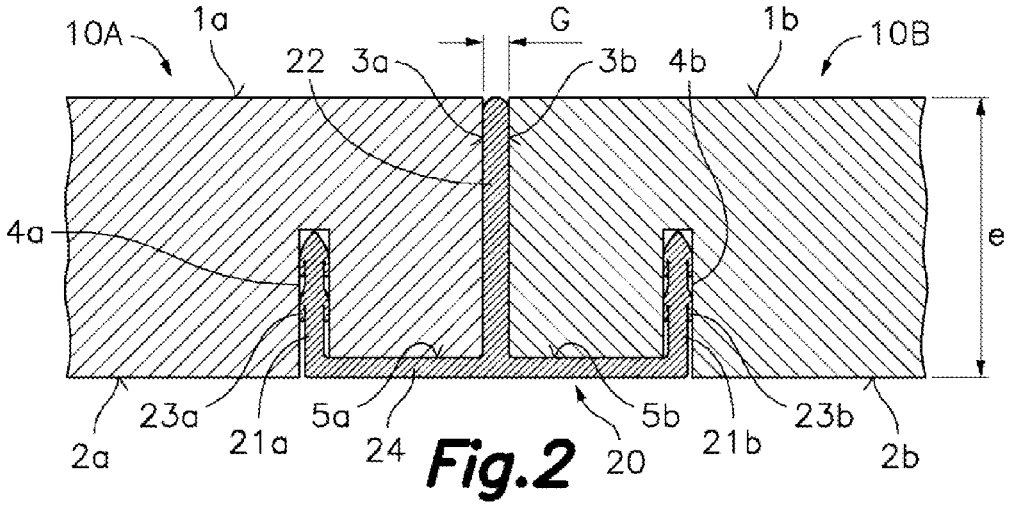
FIG. 2 is a sectioned elevational view of the two covering panels and the attachment part of FIG. 1 in a coupled position.

Referring first to FIGS. 1 and 2, there is shown a system for a floor covering according to an embodiment of the present invention comprising a set of covering panels 10A, 10B to be placed adjacent to one another to form the floor covering, and attachment parts 20 for connecting the covering panels 10A, 10B to one another.

The aforementioned covering panels 10A, 10B are essentially all the same, although to facilitate the description the covering panel depicted on the left side of FIGS. 1 and 2 has been designated as covering panel 10A and the covering panel depicted on the right side of FIGS. 1 and 2 has been designated as covering panel 10B.

Each of the covering panels 10A, 10B has an upper surface 1*a*, 1*b*, or visible surface, a lower surface 2*a*, 2*b*, or non-visible surface opposite the upper surface 1*a*, 1*b*, and perimetral edges 3*a*, 3*b* demarcating the contour thereof. In practice, and in a covering position, said lower surface 2*a*, 2*b* will be placed against a base surface of a floor (not illustrated). The covering panels 10A, 10B, which are planar and have a polygonal contour, are made of marble or marble aggregate and have relatively little thickness "e" in relation to the extension of the upper and lower surfaces 1*a*, 2*a*; 1*b*, 2*b*.

In this first embodiment shown in FIGS. 1 and 2, the covering panels 10A, 10B have recesses 4*a*, 4*b* in the form of notches or relatively narrow and deep straight channels formed in the lower surface 2*a*, 2*b* and close to the corresponding facing edges 3*a*, 3*b* thereof. These recesses 4*a*, 4*b* have a constant width and extend perpendicular to the lower surface 2*a*, 2*b*, and therefore parallel to the edge 3*a*, 3*b*, towards the inside of the covering panel 10A, 10B without reaching the upper surface 1*a*, 1*b*. The aforementioned recesses 4*a*, 4*b* span substantially the entire length of the lower surface of the covering panel 10A, 10B.

The attachment part 20 is made of a relatively flexible material, such as a plastic material, and has the form of an elongated strip having a length substantially equal to the length of the edges 3*a*, 3*b* of the covering panels 10A, 10B adjacent to the corresponding recesses 4*a*, 4*b*.

Said strip which forms the attachment part 20 is configured as a profile having a cross-section in the form of a trident having a bottom 24 from the ends of which there extend in the same direction two projecting members 21*a*, 21*b* in the form of mutually parallel flanges perpendicular to the lower surface 2*a*, 2*b*, and therefore parallel to the edges 3*a*, 3*b*, of the covering panels 10A, 10B. A spacing member 22 also in the form of a flange parallel to the two projecting members 21*a*, 21*b* extends from a middle region of said bottom 24 of the attachment part 20 and in the same direction as the projecting members 21*a*, 21*b*. This spacing member 22 of the attachment part 20 spans a height substantially equal to the thickness "e" of the covering panels 10A, 10B, although this condition is not essential.

Each of the projecting members 21*a*, 21*b* of the attachment part 20 also comprises a pair of protuberances 23*a*, 23*b* intended for forcing the fitting of the projecting member 21*a*, 21*b* inside the corresponding recess 4*a*, 4*b* of the covering panel 10A, 10B. Preferably, each of said protuberances 23*a*, 23*b* comprises a dual flap the cross-section of which has a harpoon shape favorable for its introduction in the respective recess 4*a*, 4*b* of the covering panel 10A, 10B but not favorable for its extraction therefrom, thus preventing the attachment part 20 from coming out of their housings and assuring the mutual link of the covering panels 10A, 10B. Each projecting member 21*a*, 21*b* could alternatively have a single protuberance 23*a*, 23*b* or more than two protuberances 23*a*, 23*b* with an equivalent result.

In the first embodiment shown in FIGS. 1 and 2, the covering panels 10A, 10B have undercuts 5*a*, 5*b* formed in the lower surface 2*a*, 2*b* between the edges 3*a*, 3*b* and the recesses 4*a*, 4*b*. These undercuts 5*a*, 5*b* have a depth substantially equal to the thickness of the bottom 24 of the attachment part 20.

In practice, for coupling or attaching one covering panel 10A to another covering panel 10B (FIG. 2) one of the projecting members 21*a* of the attachment part 20 is fully introduced in the recess 4*a* of one of the covering panels 10A and the other projecting member 21*b* of the attachment part 20 is fully introduced in the recess 4*b* of the other covering panel 10B. The two covering panels 10A and 10B are therefore positioned such that the spacing member 22 is housed tightly between the facing edges 3*a*, 3*b* and in contact therewith. The spacing member 22 of the attachment part 20 thus acts as a joint filling a gap "G" between the opposite edges 3*a*, 3*b* of the two adjacent covering panels 10A, 10B when they are both linked by the attachment part 20.

In this position, the bottom 24 of the attachment part 20 is housed in the undercuts 5*a*, 5*b* of the covering panels 10A and 10B, such that the attachment part 20 does not project downwards from the lower surface 2*a*, 2*b* of the covering panels 10A and 10B.

Figure 3:
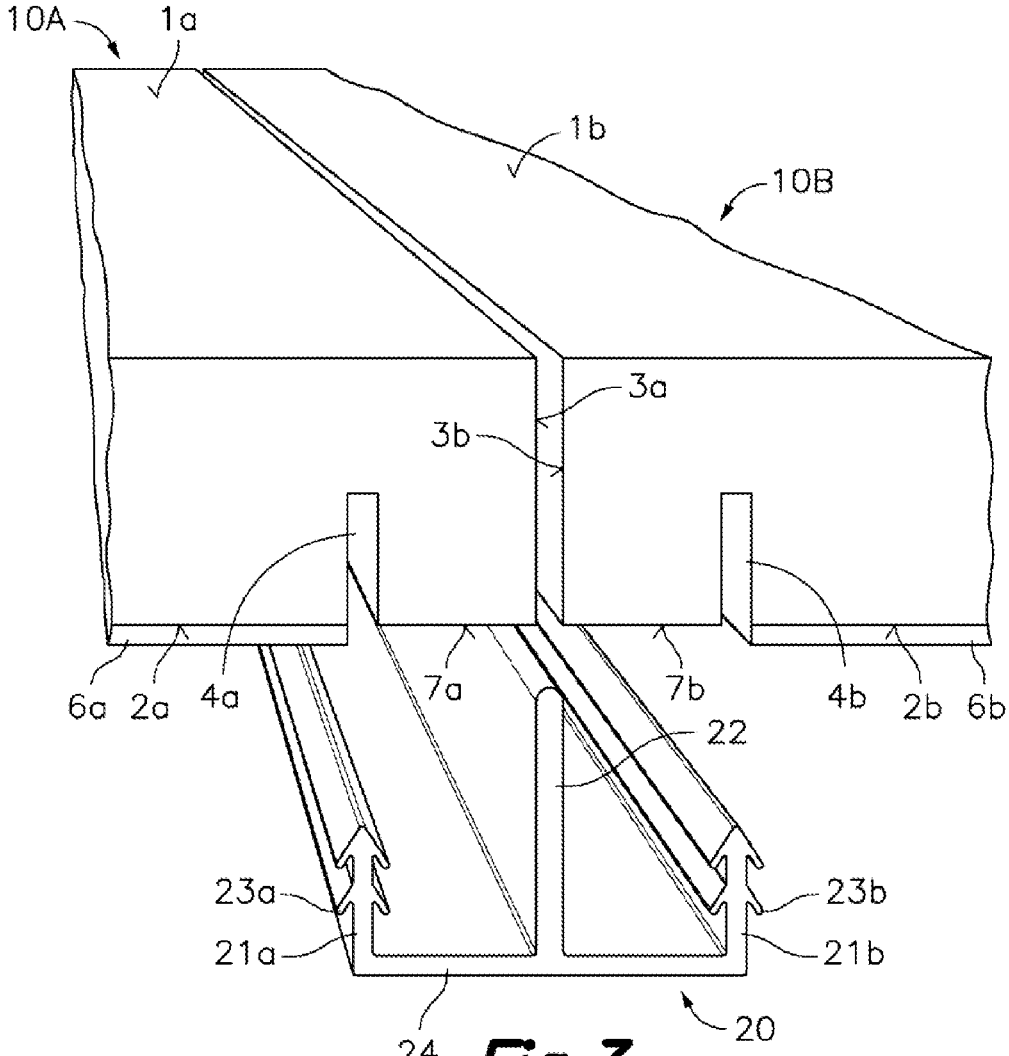
FIG. 3 is a perspective view of two covering panels and an attachment part before being attached, which form part of a system for a floor covering according to a second embodiment of the present invention.
Figure 4:
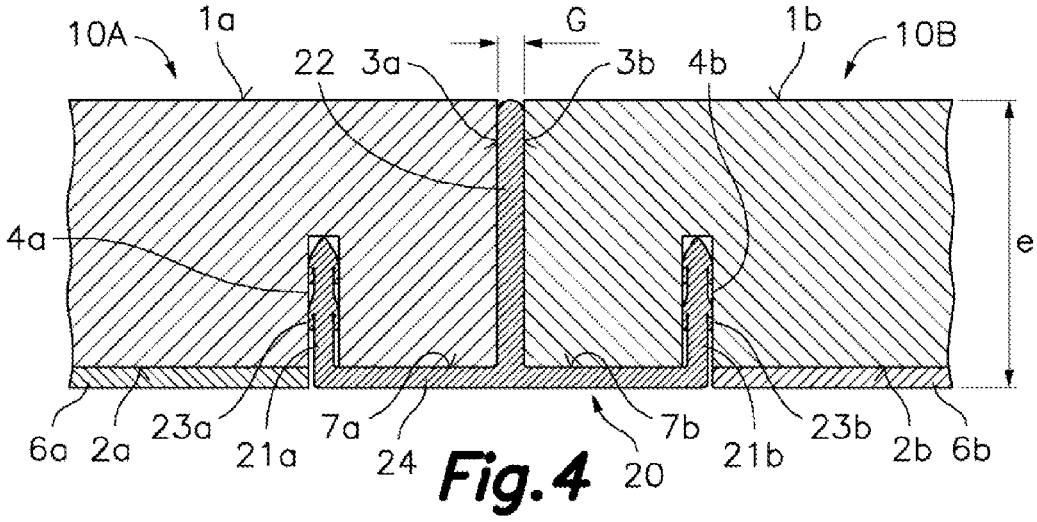
FIG. 4 is a sectioned elevational view of the two covering panels and the attachment part of FIG. 3 in a coupled position.

Now in relation to FIGS. 3 and 4, a second embodiment of the present invention is described, which is completely similar to the first embodiment described above in relation to FIGS. 1 and 2, except in that here the covering panels 10A, 10B do not have the undercuts 5*a*, 5*b* but have added respective flexible material layers 6*a*, 6*b* fixed on their lower surfaces 2*a*, 2*b*. Each of said flexible material layers 6*a*, 6*b* covers the entire corresponding lower surface 2*a*, 2*b* of the covering panel 10A, 10B except a portion of lower surface 7*a*, 7*b* extending between the corresponding edge 3*a*, 3*b* and the recess 4*a*, 4*b* adjacent thereto.

The aforementioned flexible material layers 6*a*, 6*b* can be made of foam, rubber, or another flexible material including thermoplastics, expanded polystyrene (EPS) and the like, and have a thickness substantially equal to the thickness of the bottom 24 of the attachment part 20. Thus, in the coupling position (FIG. 4), the bottom 24 of the attachment part 20 is housed between the edges of the flexible material layers 6*a*, 6*b* fixed to the covering panels 10A and 10B, such that the attachment part 20 does not project downwards from the lower surface of the flexible material layers 6*a*, 6*b*. These foam layers exert an anti-impact action.

A variant (not shown) of the first embodiment of the present invention comprises covering panels 10A, 10B and attachment parts 20 similar to those of the first embodiment described in relation to FIGS. 1 and 2, and furthermore a flexible material layer 6 separated from the covering panels 10A, 10B and arranged under the attachment parts 20. The attachment parts 20 can optionally be attached, for instance by means of adhesive, to the flexible material layer 6. In an assembled position (not shown), the bottom 24 of the attachment part 20 is housed in the undercuts 5*a*, 5*b* of the covering panels 10A and 10B and flush with the lower surfaces 2*a*, 2*b* of the covering panels 10A, 10B, such that both the lower surfaces 2*a*, 2*b* of the covering panels 10A, 10B and the bottom 24 of the attachment parts 20 rest on the flexible material layer 6.

Figure 5:
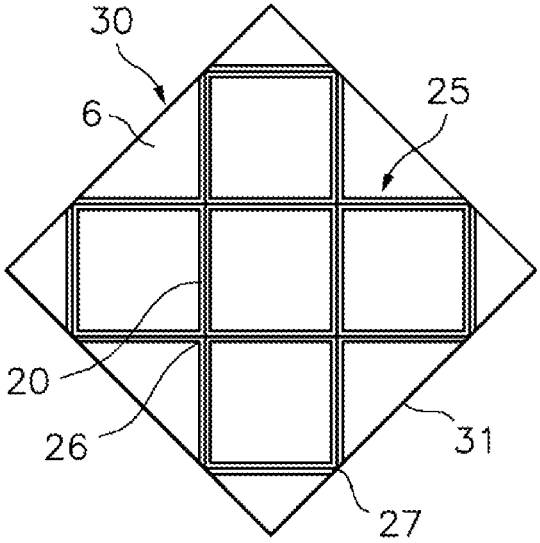
FIG. 5 is a plan view of a flexible layer element having several attachment parts adhered thereto forming a lattice, and which constitute an application of a variant of the first embodiment shown in FIGS. 1 and 2.

FIG. 5 shows an application of the mentioned variant of the first embodiment described above. In this application, the flexible material layer 6 is in the form of a plurality of regularly shaped flexible layer elements 30, which can be arranged adjacent to one another on a floor covering a desired extension thereof. Several attachment parts 20 in the form of elongated profiles arranged forming a lattice 25 with a mesh size adapted to the size of the covering panels 10A, 10B are fixed on the flexible layer elements 30. The bottom 24 of the attachment parts rests on the flexible material layer 6 of the flexible layer elements 30.

In the application example of FIG. 5, the mesh of the lattice 25 is square, adapted to square covering panels 10A, 10B, and the flexible layer elements 30 have edges 31 arranged diagonally at 45° with respect to the directions of the attachment parts 20. The lattice 25 has intersection nodes 26 in the intersections between the attachment parts 20 and the edges 31 of the flexible layer element 30 are aligned with some of said intersections providing intersection semi-nodes 27 in the intersections adjacent to the edges 31 of the flexible layer element 30. These intersection nodes and semi-nodes 26, 27 are configured such that the ends of the projecting members 21*a*, 21*b* of the attachment parts 20 adjacent to the intersections do not interfere with the corners of the covering panels 10A, 10B.

Figure 6:
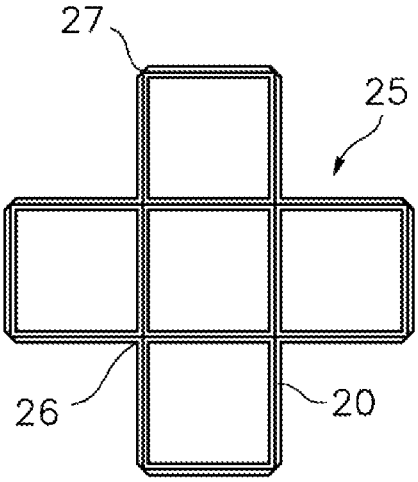
FIG. 6 is a plan view of a lattice made of attachment parts constituting an application of a variant of the first embodiment shown in FIGS. 1 and 2.

FIG. 6 shows a lattice 25 of attachment parts 20 similar to that described in relation to FIG. 5, separated from the flexible layer element 30. In this application example, the lattice 25 is a one-piece body obtained by molding a plastic material and can be fixed, for instance by adhesive, to the flexible layer element 30, or simply placed on one or more flexible layer elements 30 previously arranged on the floor forming a flexible material layer 6. In this second case, the configuration of the flexible layer elements 30 does not have to coincide with the configuration of the lattice 25.

Although FIGS. 5 and 6 show the flexible layer element 30 and the lattice 25 adapted to square covering panels 10A, 10B, they could alternatively be adapted to covering panels 10A, 10B of other shapes. The lattice 25 can span several entire meshes for housing several covering panels 10A, 10B, as shown in FIGS. 5 and 6, or a single entire mesh, or simply one or more partial meshes, for instance having four sectors of attachment part 20 forming a cross or two sectors of attachment part 20 forming an L shape.

In any of the first and second embodiments shown in FIGS. 1-4, the attachment between the covering panels 10A, 10B and the attachment parts can be reinforced by placing strips of two-sided adhesive tape (not shown) between an upper surface of the bottom 24 of the attachment parts 20 and the undercuts 5*a*, 5*b* (FIGS. 1 and 2) or the portions of lower surface 7*a*, 7*b* (FIGS. 3 and 4) of the covering panels 10A, 10B, such that the portions of lower surface of the covering panels 10A, 10B extending between the corresponding edge 3*a*, 3*b* and the recesses 4*a*, 4*b* adjacent thereto are adhered to the bottom 24 of the attachment parts 20.

In another alternative embodiment (not shown), the covering panels 10A, 10B have one or more short recesses similar to the recesses 4*a*, 4*b* shown in FIGS. 1 and 2 formed on their lower surfaces 2 but spanning only one or more portions of the length of the lower surface 2*a*, 2*b* in the direction of the corresponding edge 3*a*, 3*b*, in combination with one or more short attachment parts similar to the attachment part 20 shown in FIGS. 1 and 2 but having a length suitable for the length of said one or more short recesses.

A person skilled in the art will be able to introduce changes and modifications in the embodiments shown and described without departing from the scope of the invention as it is defined in the attached claims.

What is claimed is:

1. A system for a floor covering, comprising covering panels (10A, 10B) having opposite upper and lower surfaces (1*a*, 2*a*; 1*b*, 2*b*) and several flat lateral face edges (3*b*), and attachment parts (20) having connection elements which interact with corresponding connection elements formed in said covering panels (10A, 10B), characterized in that the covering panels (10A, 10B) are solid planar panels made of a single piece of marble or marble aggregate, wherein said lower surfaces (2*a*, 2*b*) of said covering panels have recesses (4*a*, 4*b*) extending perpendicular to said lower surface (2*a*, 2*b*); said recesses (4*a*, 4*b*) being at a distance from the flat lateral faces (3*a*, 3*b*); said recesses (4*a*, 4*b*) providing straight channels having a constant width; said attachment parts (20) being made of a relatively flexible material; said attachment parts (20) comprise two projecting members (21*a*, 21*b*) which are introduced in said recesses (4*a*, 4*b*) of two adjacent covering panels (10A, 10B) assuring the link of one covering panel (10A) with another covering panel (10B), said attachment parts (20) further comprise a spacing member (22; 22*a*, 22*b*) extending parallel to the flat lateral faces (3*a*, 3*b*) of the covering panels and arranged in the form of a joint filling a gap (G) between the opposite flat lateral face edges (3*a*, 3*b*) of two adjacent covering panels (10A, 10B) when they are both coupled to one another, and said spacing member ending in a portion that is level with said upper surfaces (1*a*, 2*a*).

2. The system for a floor covering according to claim 1, characterized in that the recesses (4*a*, 4*b*) span substantially the entire length of the lower surface or edge of the covering panel in which they are formed.

3. The system for a floor covering according to claim 1, characterized in that the recesses (4*a*, 4*b*) are formed in one or more portions of the length of the lower surface of the covering panel in which they are formed.

4. The system for a floor covering according to claim 1, characterized in that the attachment part (20) is configured as a profile having a cross-section in the form of a trident with a bottom (24) from the ends of which there extend two projecting members (21*a*, 21*b*) in the form of mutually parallel flanges perpendicular to the lower surface (2*a*, 2*b*) of the covering panels (10A, 10B), and said spacing member (22) also in the form of a flange parallel to the two projecting members (21*a*, 21*b*) extends from a middle region of said bottom (24).

5. The system for a floor covering according to claim 4, characterized in that the spacing member (22) of the attachment part (20) spans a height substantially equal to a thickness (e) of the covering panels (10A, 10B).

6. The system for a floor covering according to claim 4, characterized in that each of the projecting members (21*a*, 21*b*) of the attachment part (20) comprises at least one protuberance (23*a*, 23*b*) intended for forcing the fitting of the projecting member (21*a*, 21*b*) inside the corresponding recess (4*a*, 4*b*) of the covering panel (10A, 10B).

7. The system for a floor covering according to claim 6, characterized in that said at least one protuberance (23*a*, 23*b*) comprises a dual flap the cross-section of which has a harpoon shape favorable for its introduction in the respective recess (4*a*, 4*b*) of the covering panel (10A, 10B) but not favorable for its extraction therefrom.

8. The system for a floor covering according to claim 4, characterized in that undercuts (5*a*, 5*b*) are formed in the lower surface (2*a*, 2*b*) of the covering panels (10A, 10B) between the flat lateral face edges (3*a*, 3*b*) and the recesses (4*a*, 4*b*) adjacent thereto, said undercuts (5*a*, 5*b*) having a depth substantially equal to the thickness of the bottom (24) of the attachment part (20).

9. The system for a floor covering according to claim 4, characterized in that flexible material layers (6*a*, 6*b*) are fixed on the lower surfaces (2*a*, 2*b*) of the covering panels (10A, 10B) covering substantially all the lower surfaces (2*a*, 2*b*) with the exception of portions of lower surface (7*a*, 7*b*) between the flat lateral face edges (3*a*, 3*b*) and the recesses (4*a*, 4*b*) adjacent thereto, said flexible material layers (6*a*, 6*b*) having a thickness substantially equal to a thickness of the bottom (24) of the attachment part (20).

10. The system for a floor covering according to claim 4, characterized in that it comprises a plurality of regularly shaped flexible layer elements (30) which can be arranged adjacent to one another on a floor to form a flexible material layer (6), and several of the attachment parts (20) are arranged and fixed on each of said flexible layer elements (30) forming a lattice (25) with a mesh size adapted to the size of the covering panels (10A, 10B).

11. The system for a floor covering according to claim 5, characterized in that each of the projecting members (21*a*, 21*b*) of the attachment part (20) comprises at least one protuberance (23*a*, 23*b*) intended for forcing the fitting of the projecting member (21*a*, 21*b*) inside the corresponding recess (4*a*, 4*b*) of the covering panel (10A, 10B).

12. The system for a floor covering according to claim 11, characterized in that said at least one protuberance (23*a*, 23*b*) comprises a dual flap the cross-section of which has a harpoon shape favorable for its introduction in the respective recess (4*a*, 4*b*) of the covering panel (10A, 10B) but not favorable for its extraction therefrom.

* * * * *